United States Patent [19]

Korpela et al.

[11] Patent Number: 4,498,816

[45] Date of Patent: Feb. 12, 1985

[54] MINE ROOF SUPPORT SYSTEM

[75] Inventors: Thomas Korpela, Oil City; Joseph Subrick, Connellsville, both of Pa.

[73] Assignee: United States Steel Corporation, Pittsburgh, Pa.

[21] Appl. No.: 526,259

[22] Filed: Aug. 25, 1983

[51] Int. Cl.[3] ..... E21D 20/00; E21D 21/00

[52] U.S. Cl. ..... 405/259; 405/288

[58] Field of Search ..... 405/148, 259, 260, 261, 405/288, 290

[56] References Cited

U.S. PATENT DOCUMENTS

| | | | |
|---|---|---|---|
| 2,371,789 | 3/1945 | Batten | 405/290 |
| 3,427,811 | 2/1969 | White . | |
| 3,505,824 | 4/1970 | White . | |
| 3,509,726 | 5/1970 | White . | |
| 4,274,762 | 6/1981 | Johnson . | |
| 4,349,300 | 9/1982 | Kelley | 405/259 X |
| 4,395,161 | 7/1983 | Wilson et al. | 405/259 |

OTHER PUBLICATIONS

Article from "Coal Mining & Processing," Jun. 1969–pp. 64,65,83 entitled Roof Trusses on Trial at Crown Mine.

Article from "Society of Mining Engineers, AIME," Jun. 1970, vol. 247, pp. 109, 110, entitled In-situ Roof Trusses vs. Angle Roof Bolts–A Photoelastic Comparison by S. C. Gambrell and C. D. Haynes.

*Primary Examiner*—Cornelius J. Husar
*Assistant Examiner*—Nancy J. Stodola
*Attorney, Agent, or Firm*—William F. Riesmeyer, III

[57] ABSTRACT

A mine roof-truss-bolt system and a novel clip for use in such systems are provided. The system includes opposed anchor members installed in the roof, a reinforcing member located in a passage below the roof and extending longitudinally to locations past the lower ends of the anchor members, and clips abutting the roof for connection with the anchor and reinforcing members. The system also includes apparatus for placing the anchor and reinforcing members in tension for additional support of the roof. The members are connected to the clips at locations of substantially the same elevation on the clip below the mine roof.

10 Claims, 8 Drawing Figures

MINE ROOF SUPPORT SYSTEM

BACKGROUND OF THE INVENTION

The present invention relates to a mine roof truss bolt system, and particularly to a clip for use in such system.

Truss-bolt-type systems are increasingly being used to provide additional support for mine roofs over that provided by conventionally used systems consisting of patterns of spaced vertical bolts. Truss-bolt systems are mostly used in wide entries to a long wall panel or in cross entries where the span between walls or pillars is great. The truss-bolt systems generally include two opposed anchor bolts inserted in angled holes drilled in the roof. The holes are drilled at an angle and depth so that the anchors extend upwardly to locations over the mine pillars adjoining the passage. At the lower end of each anchor, clips usually are provided to receive the anchor and a transverse reinforcing member extending laterally between the clips just below the roof face. The anchors and reinforcing member are tensioned by various devices so as to apply an upward and inward force for additional support of the roof.

There are various truss-bolt systems known in the art. U.S. Pat. No. 3,505,824, White discloses a system in which the rods extend angularly into the roof and are bent inwardly toward the center of the mine opening in overlapped relationship. The personnel installing this system must bend the rods manually after they are secured in the holes drilled in the roof. After bending, the rods are secured together and tensioned in a central area of the mine passage. Thus, not only is installation difficult and time-consuming, but it also requires that the personnel stand in the center of the passage where material from the roof is most likely to fall on them. This sytem is also described in an article published in COAL MINING AND PROCESSING, June 1969, pages 64, 65 and 83, and a paper published in the SOCIETY OF MINING ENGINEERS, AIME, June 1970, volume 249, pages 109, 110.

Another truss-bolt system shown in U.S. Pat. No. 3,427,811, White also requires that the operators stand in the center of the passage in order to apply tension to the reinforcing member. The reinforcing member in this latter system consists of two rods secured to clips at their outer ends and joined in the central passage area by a turnbuckle. U.S. Pat. No. 3,509,726, White discloses a truss-bolt system composed of two anchor members extending angularly into the roof and a reinforcing member joined at its outer ends by straps, each of which is secured in a wedge device. The opposite end of each strap is mounted in a special collar installed on the lower ends of the anchor members. The collars automatically apply tension to the reinforcing member when tension is applied to the anchor members. Installation of this system is difficult because of the relatively large number of parts. It also suffers from the disadvantage that blocks must be used between the reinforcing member and the roof reducing the amount of head clearance in the passage. Finally, U.S. Pat. No. 4,274,762, Johnson shows a truss-bolt system which requires tensioning of the reinforcing member prior to the drilling of angled holes for the anchor members. This latter system requires special equipment for installation. All of the above systems suffer from the disadvantage that the tension applied cannot be readily measured. Thus, it is often found after installation that the reinforcing member is loose and does not serve to create an upward force on the anchor members. This defeats the purpose of truss-bolting and may be hazardous in that no additional roof support is actually provided.

Another deficiency in each of these systems is that the application of force on the reinforcing member produces a force moment acting about a horizontal axis at the location where the anchor members are tensioned. This force moment tends to reduce the actual upward force applied to the roof and also creates stresses tending to weaken the clip itself.

It is therefore a primary object of this invention to provide a mine roof truss-bolt system which overcomes the disadvantages of the prior art discussed above.

It is another object of the invention to provide a mine roof truss-bolt system and clips for use in such system designed to eliminate force moments acting on said clips about horizontal axes normal to the axes of the anchor members and reinforcing member at the locations at which said members are connected to the clips.

It is still another object of the invention to provide a mine roof truss-bolt system which is easier and safer to install than prior systems.

It is a further object of the invention to provide a mine roof truss-bolt system which may be installed in separate stages.

It is still a further object of the invention to provide a mine roof truss-bolt system in which the degree of tension applied to the anchor and reinforcing members may be accurately measured so as to assure that proper support for the roof is provided.

SUMMARY OF THE INVENTION

The present invention is of a mine roof support system and a clip for use in such system which eliminates force moments acting on the clips about horizontal axes normal to the axes of an anchor member and reinforcing member at the locations at which said members are connected to the clip. The system includes a pair of spaced elongated anchor members extending in upwardly divergent directions at an approximately 45° angle with respect to the mine roof. For purposes of the claims, the term approximately is intended to mean angles with the range of plus or minus 15°, i.e. from 30° to 60°, preferably from 40° to 50°. The anchor members each have a threaded outer portion at their lower ends. The upper ends of the anchor members are secured firmly in holes drilled in the roof. The anchor members may be of the type which is mechanically anchored or of the resin anchor type. An elongated reinforcing member having opposed threaded ends is located in a passage below the mine roof and extends longitudinally to positions past the lower ends of the anchor members. The system includes a pair of clips, each having at least two ends in a first plane for abutment against the mine roof. Each of the clips has a first downwardly extending portion being inclined at an approximately 45° angle with respect to the first plane. The first downwardly extending portion of the clip has a bore therethrough perpendicular to the inclined surface for receiving the threaded lower end of one of the anchor members therethrough. Each of the clips also has a second downwardly extending portion having a planar surface facing away from said inclined surface and being substantially perpendicular to the first plane. The second downwardly extending portion has a bore therethrough perpendicular to said substantially perpendicular surface for receiving one of the opposed threaded ends of the elongated reinforcing member therethrough. The intersection of the axes of the bores for receiving the anchor member and reinforcing member respectively with said first and second surfaces are at substantially the same normal distance from said first plane. The term substantially is meant for purposes of the claims that said normal distances of the respective intersection of each of said bores with said surfaces from the first plane are within $\pm\frac{1}{4}$-inch, preferably within $\pm\frac{1}{8}$-inch of each other in a vertical direction. The axes of said bores are displaced from each other along a second plane parallel to the first plane so as to prevent the intersection of the achor member with the reinforcing member. The system also includes separate means for threadedly engaging the lower ends of the anchor members and opposed ends of the reinforcing member so that when said means are tightened against the first and second planar surfaces of the clips, the anchor members and reinforcing member are placed in tension.

DESCRIPTION OF THE PREFERRED EMBODIMENT

Figure 1:
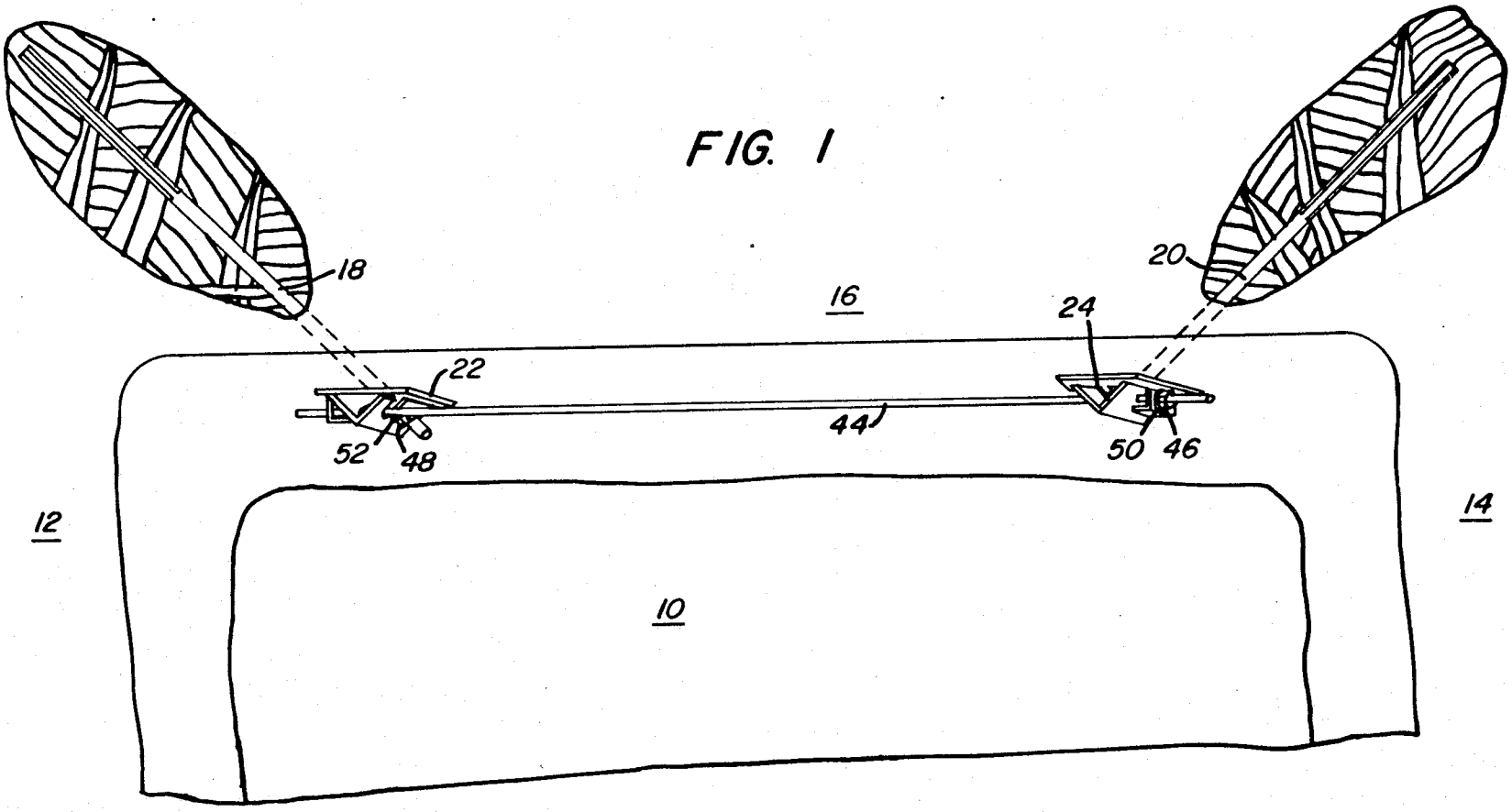
FIG. 1 is a side elevation view of the apparatus of this invention.
Figure 2:
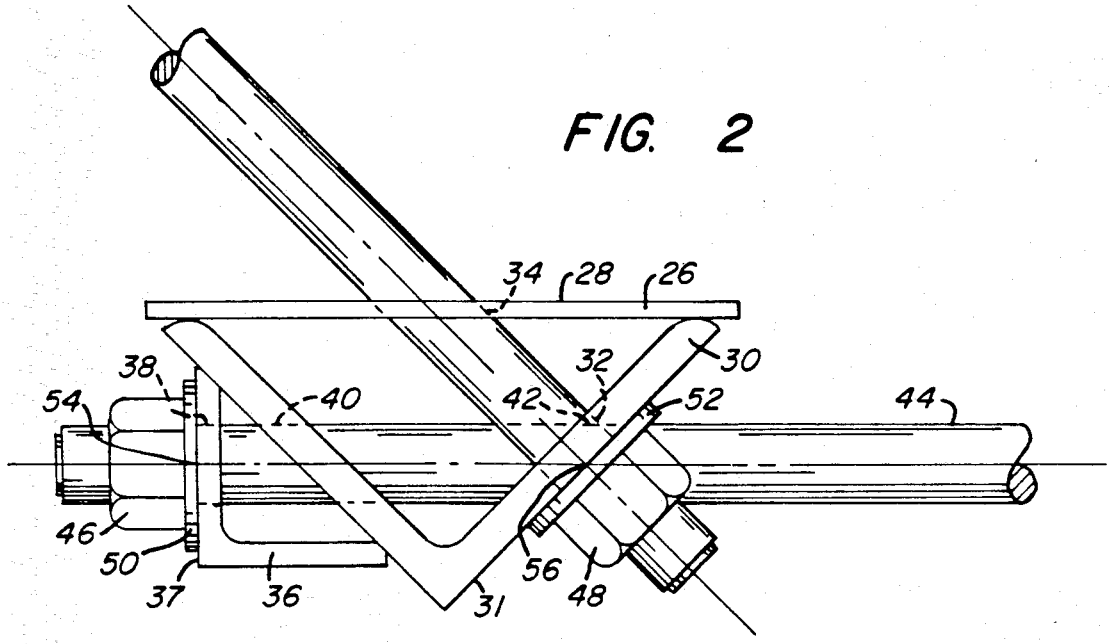
FIG. 2 is an enlarged view of part of the apparatus shown in FIG. 1.
Figure 3:
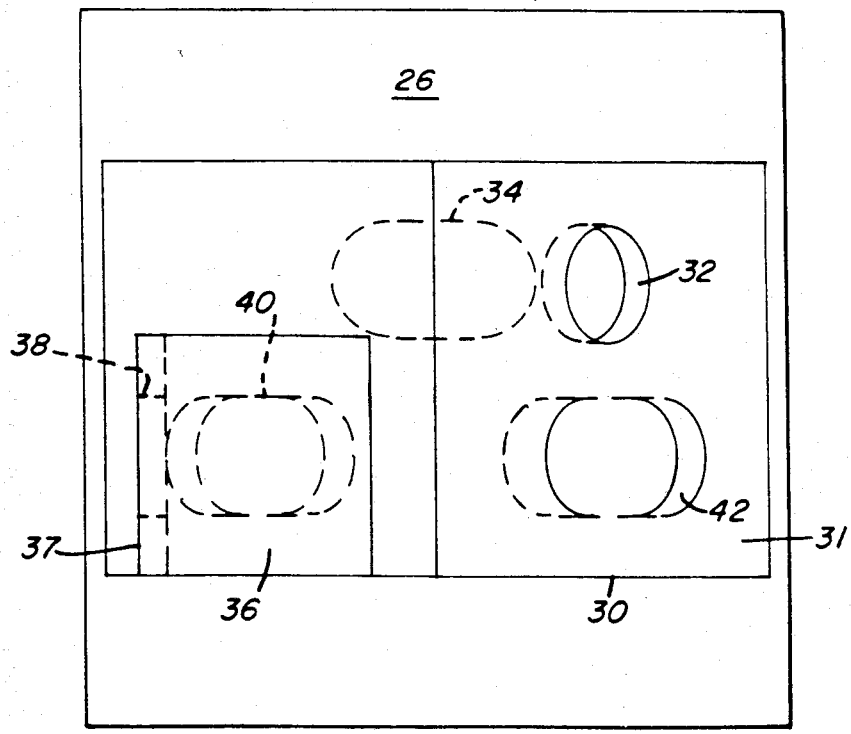
FIG. 3 is an upward plan view of the clip shown in FIG. 2.
Figure 4:
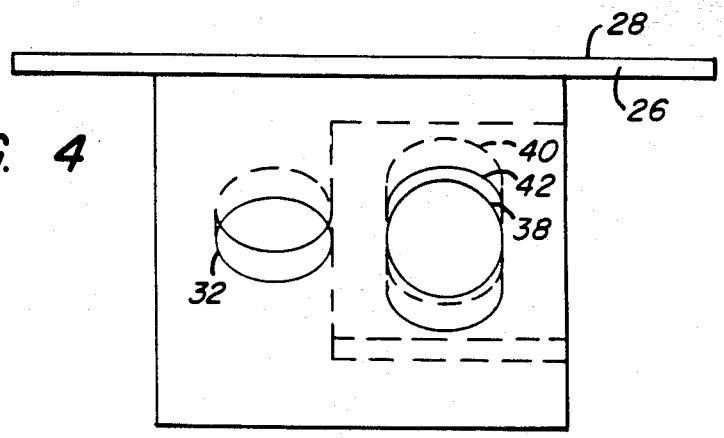
FIG. 4 is an end view of the clip shown in FIG. 3.
Figure 8:
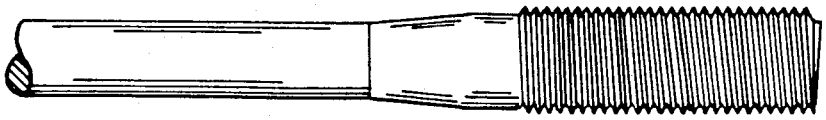
FIG. 8 is an enlarged view of an alternate reinforcing member having upset threaded ends for increased strength.

FIG. 1 shows the apparatus of the present invention installed in a mine passage 10 bounded by pillars 12, 14 and roof 16. The apparatus includes opposed anchor members 18, 20 installed in angled holes drilled in the roof. The holes are usually drilled so that the upper ends of the anchor members are located over the pillars adjacent the passage. The upper ends of the anchor members are preferably secured by resin bolting techniques well-known in the art. In this case, the anchor members have a reinforcing bar surface configuration at their upper ends and threaded lower ends. Mechanically secured anchor bolts utilizing conventional wedge-type devices may be used. The lower end of each anchor member is mounted in one of the clips 22 and 24. FIGS. 2, 3 and 4 show one of the two identical clips in greater detail. Each clip includes a plate 26 having an upper surface 28 located in a first plane for abutting the mine roof. A first right angular metal bracket 30 is welded to plate 26 and has a leg which forms a first downwardly extending portion with a planar face 31 inclined at 45°. A bore 32 suitably aligned with a bore 34 in plate 26 is adapted to receive the lower end of the anchor member therethrough. A second right angular metal bracket 36 is welded to the first bracket and has one leg which forms a second downwardly extending portion with a planar face 37 perpendicular to the plane of upper surface 28. The second downwardly extending portion has a bore 38 suitably aligned with bores 40 and 42 in the first bracket for receiving one of the threaded ends of reinforcing member 44 therethrough. The first and second metal brackets have sufficient rigidity to permit the application of a force of at least 5,000 pounds on each of them when the ends of the anchor and reinforcing members are bolted down to bear on them. Generally, the brackets have sufficient rigidity to permit application of force equal to the yield strength of the anchor member and reinforcing member. The members are secured and tensioned by nuts 46, 48 mounted over washers 50, 52 (FIG. 2). As shown in FIG. 2, the intersection 54 of the axis of bore 38 with planar face 37 is at substantially the same elevation as the intersection 56 of the axis of bore 32 with planar face 31. Thus, force moments are substantially eliminated about horizontal axes normal to the members passing through said bores at the intersection of said axes of the members with first and second planar surfaces 31 and 37. The reinforcing member may be a single rod having a body of uniform cross-section as shown, or it may be composed of multiple sections. It will be noted that the reinforcing member is spaced horizontally from the anchor members at the point of connection to the clips so that the members do not intersect. Preferably, the spacing between the anchor members and reinforcing members is not more than 1.5 inches, more preferably they are spaced only as necessary to just prevent their intersection. The reinforcing member may have upset forged (enlarged) threaded ends as shown in FIG. 8 for significantly increasing the strength of the ends to about the level of the body of the reinforcing member.

Figure 5:
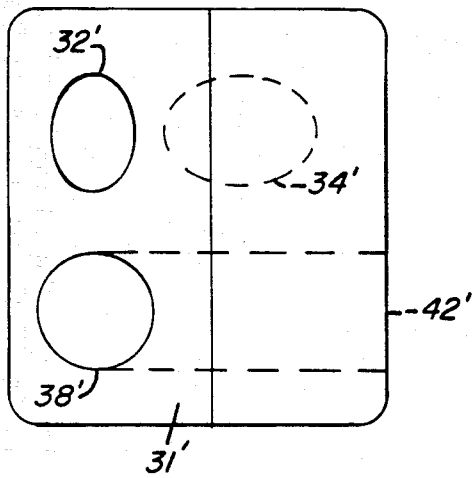
FIG. 5 is a plan view of an alternate clip for use in the apparatus of the present invention.
Figure 6:
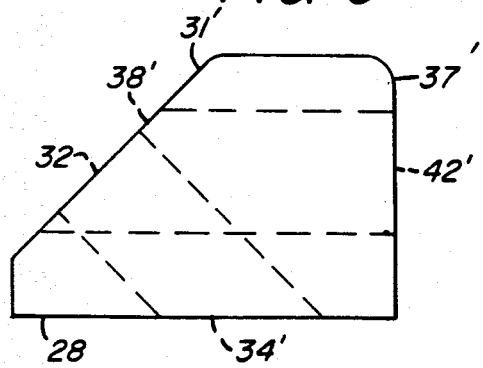
FIG. 6 is a side elevation view of the clip shown in FIG. 5.
Figure 7:
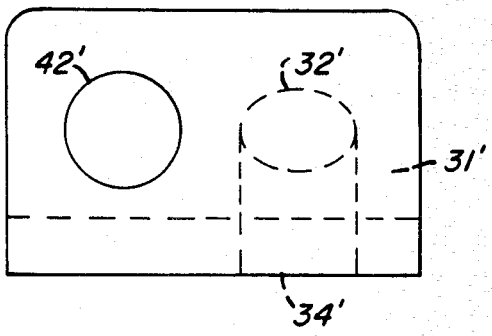
FIG. 7 is an end view of the clip shown in FIG. 6.

An alternate clip is shown in FIGS. 5, 6 and 7 which consists of a grey iron casting. The casting has planar faces 28', 31' and 37' corresponding to those of the clip shown in FIGS. 2, 3 and 4. It also has a bore extending to apertures 32' and 34' for receiving the lower end of one of the anchor members therethrough and a bore extending to apertures 38' and 42' for receiving the reinforcing member similar to the clip previously described.

A significant advantage of the invention is that it may be installed in stages, for example, a plurality of anchor member and clips may be installed and tensioned along the length of a passage. Subsequently, the reinforcing members may be installed and tensioned as required. Still another advantage of the invention is that the tension applied to the members may be accurately measured. Perhaps, even more importantly tension is applied by a workman at the location of the clips instead of at a midpoint of the reinforcing member between the clips. Thus, the workman is positioned at a location adjacent the mine pillars which is the safest from the standpoint of being in an area where a roof fall is least likely to occur. The tension may be readily measured by the turn-of-the-nut method, the use of torque wrenches, or by installing hydraulic load cells on the members between the clips and the nuts.

Those and other embodiments of the invention will be readily apparent to those skilled in art and are intended to be covered within the scope of the appended claims in which:

We claim:

1. A clip for use in a mine roof truss bolt system comprising:

at least two ends aligned in a first plane for abutment against the mine roof;

a first downwardly extending portion having a planar surface facing away from the mine roof and inclined at an approximately 45° angle with respect to said first plane, said portion having a bore therethrough perpendicular to said inclined surface for receiving the lower end of an anchor member therethrough;

a second downwardly extending portion having a planar surface facing away from said inclined surface and substantially perpendicular to said first plane, said second portion having a bore therethrough perpendicular to said substantially perpendicular surface for receiving one end of an elongated reinforcing member through the bore;

said bores for receiving the anchor member and reinforcing member having axes intersecting with said first and second surfaces at substantially the same distance in a normal direction from said first plane, said axes being displaced from each other in a second plane parallel to said first plane so as to prevent the intersection of said anchor member with said reinforcing member;

said first and second downwardly extending portions being rigidly connected in a third plane parallel to said first and second planes and spaced downwardly from said second plane;

said first and second downwardly extending portions having sufficient rigidity to permit the application of a force on each of said first and second surfaces of at least 5,000 pounds when the ends of said anchor and said reinforcing members are bolted down to bear on said first and second surfaces.

2. The clip of claim 1 wherein the said first and second downwardly extending portions are rigidly connected in a third plane parallel to said first and second planes and spaced downwardly from said second plane.

3. The clip of claim 1 further comprising a first metal plate having an upper surface for abutting the mine roof, and wherein said downwardly extending portions are metal plates welded to the lower surface of said first plate.

4. The clip of claim 3 wherein said bore for receiving the reinforcing member therethrough extends through both of the metal plates forming the first and second downwardly extending portions of the clip.

5. The clip of claim 4 wherein the metal plates forming said first and second downwardly extending portions each comprise one of two opposed legs of respective first and second right angular metal brackets, said legs of the second bracket being welded to the downwardly facing outer surface of the other leg of said first bracket.

6. A mine roof support comprising:

a pair of spaced elongated anchor members extending in upwardly divergent directions in the mine roof at an approximately 45° angle with respect to the plane of said roof, said anchor members each having a threaded outer portion at the lower end thereof.

an elongated reinforcing member having opposed threaded ends, said reinforcing member being located in a passage below the mine roof and extending longitudinally to positions past the lower ends of the anchor members, a pair of clips, each having at least two ends aligned in a first plane for abutment against the mine roof;

each of said clips having a first downwardly extending portion being inclined at an approximately 45° angle with respect to said first plane, said portion having a bore therethrough perpendicular to said inclined surface for receiving the lower end of said one of the anchor members therethrough, each of said clips also having a second downwardly extending portion having a planar surface facing away from said inclined surface and substantially perpendicular to said first plane, said second portion having a bore therethrough perpendicular to said substantially perpendicular surface for receiving one end of an elongated reinforcing member through the bore, said bores for receiving the anchor member and reinforcing member having axes intersecting with said first and second surfaces at substantially the same distance in a normal direction from said first plane, said axes being displaced from each other along a second plane parallel to said first plane so as to prevent the intersection of said anchor member with said reinforcing member, said first and second downwardly extending portions being rigidly connected in a third plane parallel to said first and second planes and spaced downwardly from said second plane;

separate means for threadedly engaging the lower ends of the anchor members and opposed ends of the reinforcing member, said means being adapted to be tightened so as to be on said first and second planar surfaces placing the anchor and reinforcing members in tension.

7. The mine roof support of claim 6 wherein said first and second downwardly extending portions are rigidly connected in a third plane parallel to said first and second planes and spaced downwardly from said second plane.

8. The mine roof support of claim 6 further comprising a first metal plate having an upper surface for abutting the mine roof, and wherein said downwardly extending portions are metal plates welded to the lower surface of said first plate.

9. The mine roof support of claim 8 wherein said bore for receiving the reinforcing member extends through both of the metal plates forming the first and second downwardly extending portions of the clip.

10. The mine roof support of claim 9 wherein the metal plates forming said first and second downwardly extending portions of the clip each comprise one of two opposed legs of respective first and second right angular metal brackets, said legs of the second bracket being welded to the downwardly facing outer surfaces of the other leg of said first bracket.

* * * * *